United States Patent [19]

Landolt

[11] 4,179,862

[45] Dec. 25, 1979

[54] VACUUM PACKING MACHINE WITH BAG END RETRACTOR

[75] Inventor: Bruno Landolt, Herisau, Switzerland

[73] Assignee: Inauen Maschinen AG, Herisau, Switzerland

[21] Appl. No.: 916,998

[22] Filed: Jun. 19, 1978

[51] Int. Cl.[2] ..... B65B 31/02

[52] U.S. Cl. ..... 53/86; 53/512

[58] Field of Search ..... 53/79, 86, 89, 94, 95, 53/512

[56] References Cited

U.S. PATENT DOCUMENTS 3,699,742 10/1972 Giraudi ..... 53/86

*Primary Examiner*—Travis S. McGehee

*Attorney, Agent, or Firm*—Sughrue, Rothwell, Mion, Zinn and Macpeak

[57] ABSTRACT

A vacuum packing machine has means for automatically pulling the extending open end 6 of a product bag back into the vacuum chamber 2 when the cover 3 is closed. Such means comprises a spring loaded rod 10 fastened to the cover for pressing the end of the bag into a groove 9 hollowed out in the edge 8 of the packing machine housing 1.

4 Claims, 1 Drawing Figure

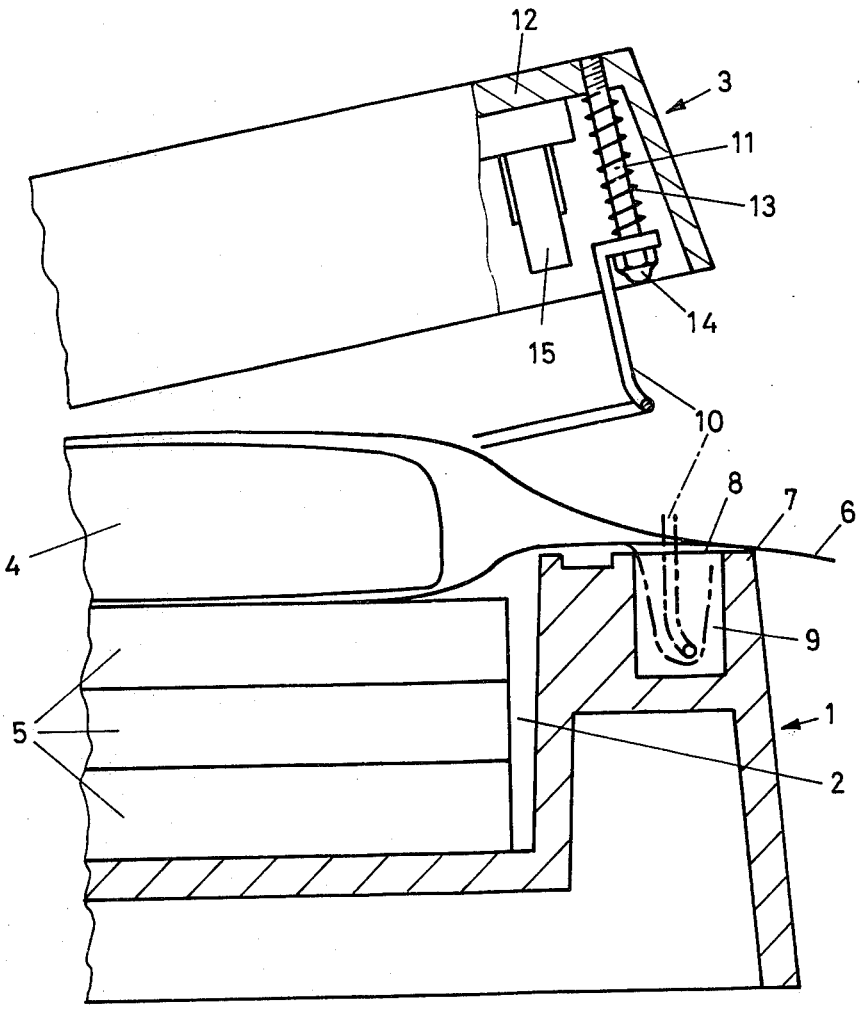
12
3
11
13
14
15
10
8
7
6
4
9
5
1
2

VACUUM PACKING MACHINE WITH BAG END RETRACTOR

BACKGROUND OF THE INVENTION

The invention is concerned with a vacuum packing machine for meat products or the like having novel means for automatically retracting a projecting end of the product bag when the vacuum chamber cover is closed.

In conventional vacuum packing machines the bagged product or material is placed in the vacuum chamber with the cover of the machine open. Depending upon the length of the bag, its open end projects out of the machine to some extent. Since the bag is evacuated during the packing process, its open end must be entirely enclosed by the machine. That is, any projecting open end of the bag that remains outside of the vacuum chamber may be temporarily pinched shut when the cover is closed, to thereby retain air in the bag and subsequently contaminate a perishable product. Further, during evacuation, the bag is drawn tightly against the product, and in taking up its "slack" in this manner the end of the bag pinched by the cover may become caught and tear or rupture. For this purpose, the end of the bag projecting from the machine is manually pressed into a recess formed in the edge of the vacuum chamber housing. The cover is then closed and the packing process begins.

SUMMARY OF THE INVENTION

An object of this invention is to make this work function simpler and more efficient by providing the machine with a device for automatically pulling back the projecting open end of a product bag placed in the vacuum chamber. Basically, a groove is hollowed out in the edge of the vacuum chamber housing, and an elongated rod spring mounted to the underside of the cover penetrates into the groove when the cover is closed to thereby force the end of the bag projecting out of the machine into the groove.

BRIEF DESCRIPTION OF THE DRAWING

An embodiment of the invention is explained in greater detail in the single drawing FIGURE, which shows a partial cross-sectional view of a vacuum packing machine constructed in accordance with the present invention.

DETAILED DESCRIPTION OF THE PREFERRED EMBODIMENT

The machine has a housing 1 defining a vacuum chamber 2 that can be closed in an airtight manner by a hinged cover 3. The bagged product 4, such as meat cuts, for example, is placed in the chamber 2 for evacuation, with filler plates 5 also being placed in the bottom of the chamber depending upon the height of the product. The end 6 of the bag projects beyond the edge 7 of the housing. A groove 9 is hollowed out in an edge 8 of the housing facing the cover 3, into which the projecting end 6 of the bag is pressed before evacuation. The groove 9 may extend around the entire periphery of the vacuum chamber, although this cannot be seen in the partial drawing figure.

A rod 10 is installed on the cover 3 and penetrates into the groove 9 when the cover is closed, to thereby automatically press the end 6 of the bag into the groove. The rod 10 is loosely mounted on the inside of the cover 3 by threaded bolts 11 anchored in the underside of the cover and carrying compression springs 13 which bias the rod, which is slidable on the bolts 11, away from the cover. The rod 10 may similarly extend around the entire cover periphery. Cover nuts 14 are screwed onto the bolts. By means of the springs 13 the end 6 of the bag is forced into the groove 9 at a uniform pressure, while the flexible mounting of the rod avoids any possibility of accidents. If when closing the cover the rod encounters resistance, caused, for example, by the hand or finger of the operator, it springs completely back into the cover.

By pulling the end of the bag automatically into the groove when the cover closes as described above, a quick, simple and efficient method of operation is achieved. In addition, a conventional apparatus 15 for weld-sealing the bag may be provided. Thus, when the cover is closed, not only is the surplus material of the bag end forced into the groove, but the bag is simultaneously double seam welded adjacent the product. The extending or surplus bag neck can later be cleanly severed along the outer weld line.

The vacuum or air exhaust passage(s), not shown, is provided in the machine housing 1 and communicates with the chamber 2 and the interior or underside of the cover 3 when the latter is closed.

What is claimed is:

1. A vacuum packing machine having a vacuum chamber (2) defined by a housing (1), and a cover (3) for closing the chamber, characterized by: a recessed groove (9) defined in an edge (7) of the housing, and an elongated member (10) fastened to the cover (3) and disposed opposite the groove and generally parallel thereto when the cover is open for penetrating into the groove (9) when the cover is closed to automatically force end flaps (6) of a product bag projecting out beyond the housing edge into the groove, whereby the end flaps of the product bag are all drawn within the chamber to enable the subsequent vacuum evacuation of the bag.

2. Vacuum packing machine as claimed in claim 1, wherein the elongated member comprises a rod (10) resiliently mounted at a fixed distance from the underside (12) of the cover (3), and which can be retracted into the cover against spring tension.

3. Vacuum packing machine as claimed in claim 2, wherein the rod (10) is slidably disposed on bolts (11) anchored to the underside (12) of the cover, and compression springs (13) are disposed on the bolts (11) and bias the rod away from the underside of the cover.

4. Vacuum packing machine as claimed in claim 1, further comprising means (15) for welding the end flaps of the bag mounted in the cover or on the edge of the housing.

* * * * *